United States Patent [19]

Zeigler, Jr. et al.

[11] 4,224,883

[45] Sep. 30, 1980

[54] APPARATUS FOR MANUFACTURING PILLOWCASES

[75] Inventors: George E. Zeigler, Jr.; Charles B. Sumpter, Jr.; Carl A. Wortham, all of Eden, N.C.

[73] Assignee: Fieldcrest Mills, Inc., Eden, N.C.

[21] Appl. No.: 24,879

[22] Filed: Mar. 28, 1979

Related U.S. Application Data

[62] Division of Ser. No. 865,731, Dec. 29, 1977.

[51] Int. Cl.[2] ..... D05B 13/00

[52] U.S. Cl. ..... 112/10; 112/304; 112/307

[58] Field of Search ..... 112/121.29, 121.11, 112/121.12, 121.15, 303, 288, 253, 262, 10, 304, 307

[56] References Cited

U.S. PATENT DOCUMENTS

| | | | |
|---|---|---|---|
| 1,830,192 | 11/1931 | Cooper | 112/10 |
| 1,888,949 | 11/1932 | Henares | 112/10 |
| 2,694,372 | 11/1954 | Hadfield | 112/121.11 |
| 2,940,404 | 6/1960 | Damon | 112/121.15 X |
| 3,041,987 | 7/1962 | Kaplan et al. | 112/10 |
| 3,126,848 | 3/1964 | Gastonguay | 112/10 |
| 3,224,394 | 12/1965 | Dobner et al. | 112/10 |
| 3,227,118 | 1/1966 | Gore | 112/10 |
| 3,227,119 | 1/1966 | Gore et al. | 112/10 |
| 3,467,037 | 9/1969 | Frydryk | 112/121.15 |
| 3,490,403 | 1/1976 | Boucraut | 112/288 X |
| 3,749,040 | 7/1973 | Jurgens | 112/288 X |
| 3,773,002 | 11/1973 | Burton | 112/121.12 |

*Primary Examiner*—Ronald Feldbaum

*Attorney, Agent, or Firm*—Bell, Seltzer, Park & Gibson

[57] ABSTRACT

A continuous, automated method and apparatus for manufacturing pillowcases in which a hem is continuously formed along one longitudinal edge of an indeterminate length fabric, and the fabric is thereafter successively cut to length and folded, with the folded pieces being sewn along the side and end thereof to form successive completed pillowcases. The versatile method and apparatus of this invention is ad pted for manufacturing pillowcases of the conventional folded hem style, as well as pillowcases of the attached hem and mock attached hem styles.

12 Claims, 23 Drawing Figures

APPARATUS FOR MANUFACTURING PILLOWCASES

This is a division of application Ser. No. 865,731, filed Dec. 29. 1977.

BACKGROUND OF THE INVENTION

This invention relates to a method and apparatus for manufacturing pillowcases or similar articles, and more particularly to a versatile apparatus and method suitable for forming pillowcases of various different styles.

Pillowcases are conventionally manufactured in several different styles, the most common style having a relatively plain hem wherein the fabric at the mouth of the pillowcase is folded back along the interior of the pillowcase and sewn thereto to form a plain folded hem. A more stylized type of pillowcase utilizes a separate attached piece of fabric at the mouth of the pillowcase to form what is commonly referred to as an attached border or attached hem. Often the attached hem is of a contrasting color fabric from the fabric forming the body portion of the pillowcase, and often lace or decorative trim is included between the body portion of the pillowcase and the attached hem portion. In still another style of pillowcase, which is commonly referred to as a mock attached hem style, the fabric at the mouth of the pillowcase is folded back along the exterior of the pillowcase and sewn to the underlying fabric, usually with an additional piece of trim or lace positioned therebetween to thereby give the appearance of a separate attached hem.

The most common method of manufacturing all of the above types of pillowcases is a semi-automated operation utilizing sewing machines, but requiring operators to handle the fabric and guide it through the sewing machine to form the various seams and hems in the pillowcase. While machines have been proposed for partially or completely automating the pillowcase manufacturing operation, as shown for example in U.S. Pat. Nos. 2,694,372, 2,940,404, 3,126,848 and 3,227,118, these machines either require that the hemming operation be done manually, or else the machines are limited to the plain folded type of hem. So far as applicant is aware there is no machine available for automatically manufacturing pillowcases of the attached hem style.

OBJECTS AND SUMMARY OF THE INVENTION

With the foregoing in mind it is a primary object of this invention to provide a method and apparatus for the automated manufacture of pillowcases of the attached hem style.

It is another important object of this invention to provide a versatile method apparatus which is suitable for also forming pillowcases of the conventional folded hem style as well as the mock attached hem style.

It is still another object of this invention to provide a method and apparatus of the type described which utilizes work stations of unique and improved construction and method of operation for carrying out the successive operations in the manufacture of the pillowcase, e.g. for hemming the fabric, for cutting fabric to length, for folding the cut fabric, and for sewing along the sides and ends of the folded fabric to form a completed pillowcase.

In accordance with this invention a fabric web having a hem formed along one longitudinal edge thereof is continuously formed into pillowcases by a method which comprises advancing the fabric web along a predetermined path to a cutting station and cutting the web into individual pieces of predetermined length while successively folding the cut pieces along a transversely extending fold line located medially of the cut edges to position the cut edges of each successive piece in opposing relation to one another. The folded pieces are then successively advanced to a side seaming station and sewn along the opposing cut edges to form a seam therealong while also forming chain stitches extending between and interconnecting the successive pieces. The chain stitches which interconnect the successive pieces are successively severed, and the successive pieces are directed from the side seaming station to an end seaming station. At the end seaming station, the pieces are successively sewn along the edge located opposite the hem to form a seam therealong thereby closing the ends of the successive pieces to form completed pillowcases therefrom.

In a preferred aspect of the invention, the advancing of the folded pieces to the side seaming station comprises successively advancing the folded pieces with the hemmed longitudinal edges at the leading end of the successive pieces to insure that the hemmed longitudinal edges are sewn together in substantial alignment with one another. The method also includes capturing the end portion of the severed chain stitch extending at the leading end of each successive piece upon the severing of the chain stitch from the preceding piece, and positioning the captured end portion of the chain stitch along the cut edges of the piece. During the sewing of the piece at the side seaming station, the chain stitch is sewn into the seam being formed along the piece to thereby prevent unraveling of the end portion of the chain stitch and to also prevent the chain from protruding from the mouth of the pillowcase.

The method of this invention, as particularly applied to the manufacture of pillowcases having an attached hem along the mouth thereof, comprises the steps of advancing from a supply source an indeterminate length relatively narrow width fabric web for forming a hem, while longitudinally folding the web about the midpoint of its width so that the longitudinal edge portions thereof are positioned in opposing relation to one another, and while simultaneously advancing from another supply source an indeterminate length relatively wider fabric web for forming the body portion of a pillowcase and positioning one longitudinal edge thereof between the opposing longitudinal edge portions of the folded hem-forming web.

The thus associated hem-folding and body-forming webs are directed through a sewing station and the opposing edge portions of the folded hem-forming web and the portion of the body-forming web positioned therebetween are sewn together to form an attached hem along one longitudinal edge of the body-forming web. The thus hemmed body-forming web is directed from the sewing station to a cutting station and is cut into individual pieces of predetermined length, with the thus cut pieces being thereafter folded along a transversely extending fold line located medially of the cut edges to position the cut edges of each successive piece in opposing relation to one another and with the hemmed longitudinal edges in substantial alignment with one another. The thus folded pieces are then sewn along the opposing cut edges and along the edge located opposite the attached hem to thereby form successive pillowcases with an attached hem thereon.

The apparatus in accordance with this invention includes a plurality of successively arranged work stations which operate in timed relation to one another for first forming a hem in a fabric, then cutting the fabric to a predetermined length, then folding the cut fabric, and subsequently sewing the folded fabric along the side and along the end thereof to form a completed pillowcase.

The hemming station includes a hem folding station which is utilized in forming pillowcases of the folded hem or mock attached hem style, and a hem sewing station where a sewing machine is positioned for sewing the hem along one longitudinal edge of the fabric.

The cutting station is positioned for receiving the hemmed web from the hemming station and includes cutter means for cutting the web into sucessive individual pieces of predetermined length. More particularly, the cutting station comprises means for successively grasping the leading cut edge of the hemmed web at the cutter means and pulling the leading cut edge of the web downstream for a predetermined distance. This means for successively grasping and pulling the leading cut edge of the hemmed web comprises an elongate endless conveyor and a plurality of sets of grippers carried by the conveyor and adapted for movement therewith along a repeating endless path. One end portion of the elongate conveyor is located adjacent to the cutter means and positioned to bring the respective sets of grippers into grasping engagement with the leading cut edge of the web at the cutter means. The conveyor extends downstream from the cutter means and beyond a folding bar for a predetermined distance. The sets of grippers are so located on the conveyor that one set of grippers is completing the pulling of the web downstream and beyond the folding bar while another set of grippers is being brought into position adjacent to cutter means for grasping and pulling the web.

The folding station includes a folding bar located downstream from the cutter means a predetermined distance, and means operating in timed relation with the cutting of the web by the cutter means for grasping the severed web at the folding bar and removing the same therefrom to form a fold.

A side seaming station is positioned for receiving the successive folded pieces from the folding station and includes means for sewing along the closely adjacent cut edges of the successive pieces to form a seam therealong while also forming chain stitches extending between and interconnecting the successive pieces. The side seaming station also includes means for successively severing the chain stitches which interconnect the successive pieces.

The end seaming station is positioned for receiving the successive pieces from the side seaming station and includes means for sewing each successive piece along the edge located opposite the hem to form a seam therealong and thereby close the ends of the pieces to form successive completed pillowcases therefrom.

BRIEF DESCRIPTION OF THE DRAWINGS

Some of the objects and features of the invention having been stated, others will become apparent as the description proceeds, when taken in connection with the accompanying drawings, in which.

DETAILED DESCRIPTION OF THE ILLUSTRATED EMBODIMENTS

Figures 1, 1A, 2:
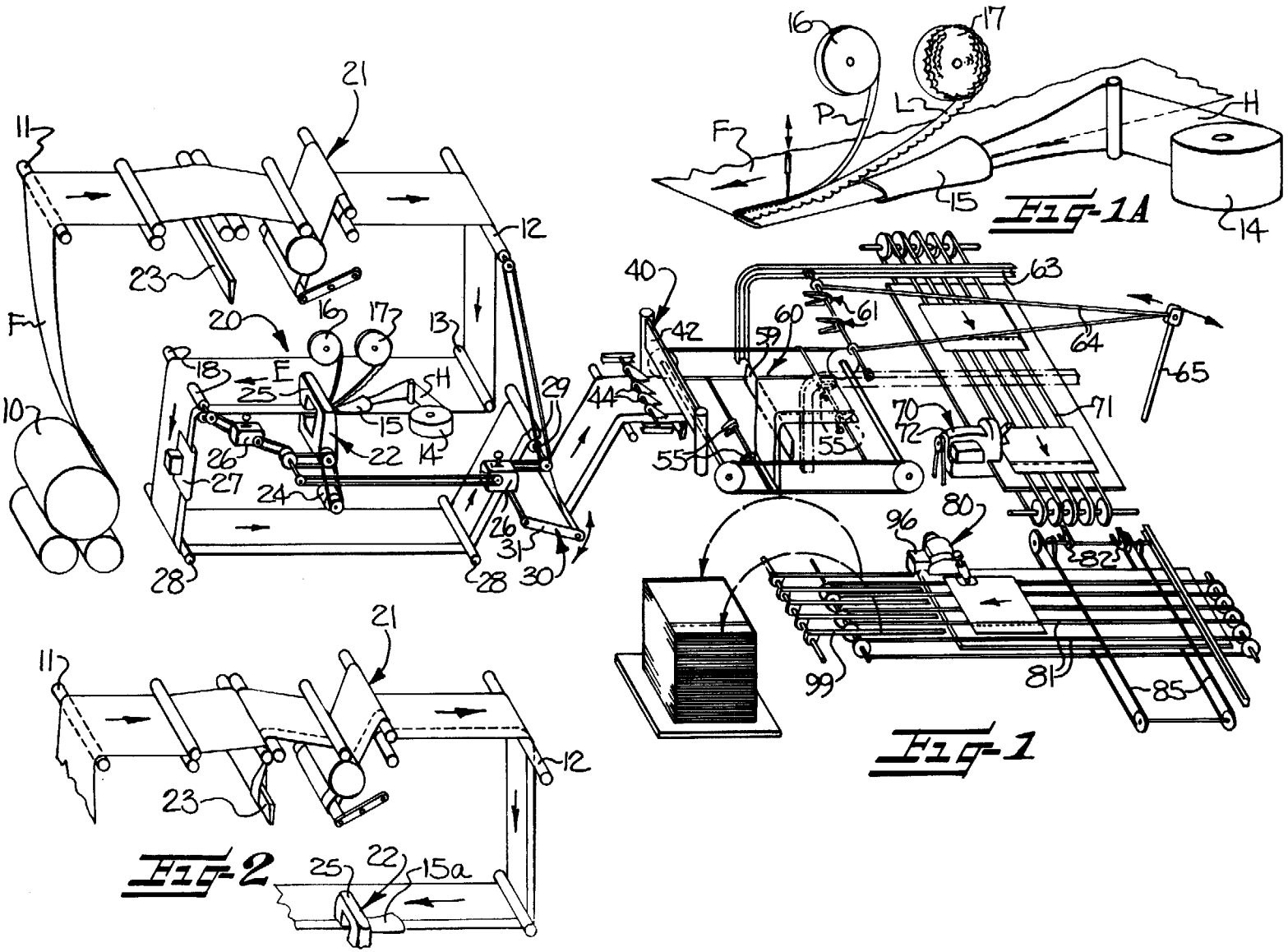
FIG. 1 is a schematic perspective view showing an apparatus for manufacturing pillowcases in accordance with this invention, and wherein the apparatus is set up for manufacturing pillowcases of the attached hem style.
FIG. 1A is a detailed schematic view of the apparatus for folding the hem forming fabric and combining it with the body forming fabric and decorative trim just prior to sewing the same together.
FIG. 2 is a fragmentary schematic perspective view showing an alternate arrangement for the apparatus for manufacturing pillowcases of the folded hem style.

The pillowcase manufacturing machine of this invention comprises several successively arranged work stations at which various successive operations are performed in the manufacture of the pillowcase. As illustrated in FIG. 1, an indeterminate length relatively wide fabric web F is supplied from a suitable supply source such as a fabric roll 10 and is advanced first to a hemming station, indicated generally by the reference character 20. Following hemming, the fabric is advanced to a cutting station 40 where the fabric is successively cut into individual pieces of predetermined length. The cut pieces are advanced from the cutting station to a folding station 60 and folded along a line located medially of the cut edges of the fabric. The folded cut pieces are then deposited on a conveyor and successively advanced through a side seaming station 70 where the opposing cut edges of the pieces are sewn together. The successive pieces are then transferred to another conveyor and advanced through an end seaming station 80 where a seam is formed along the end portion of each successive piece to form completed pillowcases therefrom. The successive pillowcases then progress to a stacking station and are successively deposited in a stack.

As noted earlier, the apparatus and method of this invention have versatility to permit manufacturing pillowcases of various different styles. FIG. 1 illustrates the apparatus as set up for manufacturing pillowcases of the attached hem style, while FIG. 2 illustrates an alternate arrangement for the hemming station 20 when pillowcases of the conventional folded hem style are being manufactured.

Figure 3:
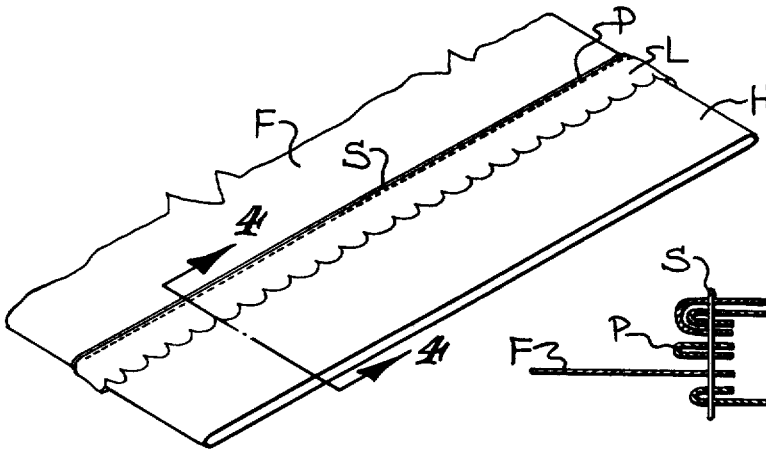
FIG. 3 is a fragmentary perspective view showing a pillowcase of the attached hem style.
Figure 4:
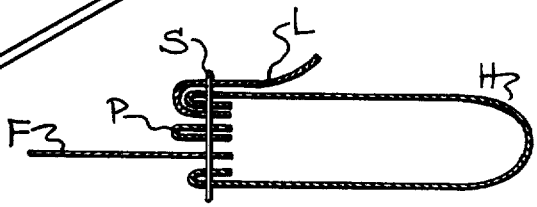
FIG. 4 is a cross sectional view of an attached hem style pillowcase taken substantially along the line 4—4 of FIG. 3.

FIGS. 3 and 4 illustrate a pillowcase of the attached hem style. As best seen in FIG. 4, this style of pillowcase includes a relatively wide fabric F for forming the body portion of the pillowcase, and a separate relatively narrow fabric H, often of a contrasting color from the body-forming fabric F, and which serves for forming the hem portion of the pillowcase. As illustrated, the hem-forming fabric H is in a folded configuration with the opposite edge portions thereof being positioned on opposite sides of an edge of the body-forming fabric F and being secured to the body-forming fabric by stitching S. Additionally, one or more pieces of decorative trim may be optionally included in the seam to enhance the appearance of the pillowcase. The particular style of attached hem pillowcase illustrated in FIG. 4 includes two separate decorative trims, a piping P of a color contrasting both with the body-forming fabric F and with the hem-forming fabric H, and a lace trim L, both of these trims being secured to the pillowcase by the same stitching S which secures the hem-forming fabric H to the body-forming fabric F.

Figure 5:
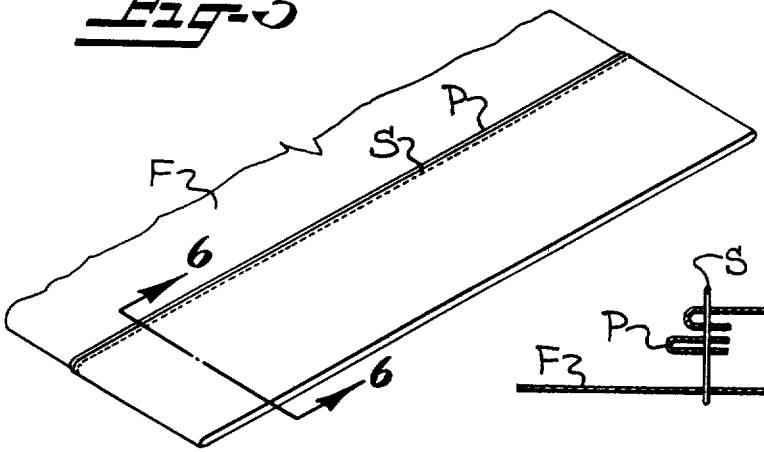
FIG. 5 is a fragmentary perspective view showing a pillowcase of the mock attached hem style.
Figure 6:
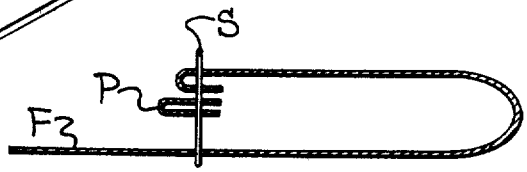
FIG. 6 is a cross sectional view of a mock attached hem style pillowcase taken substantially along the line 6—6 of FIG. 5.

FIGS. 5 and 6 illustrate a pillowcase of a style often referred to as a mock attached hem. As best seen in FIG. 6, this style of pillowcase is formed by folding the body-forming fabric F outwardly upon itself, and securing the outwardly folded portion to the underlying body-forming portion by stitching S. As in the attached hem style, one or more pieces of decorative trim may be inserted in the stitching for providing an enhanced decorative appearance to the pillowcase. As shown in FIG. 6, a single strip of decorative piping P is included in the seam formed by the line of stitching S.

Figure 7:
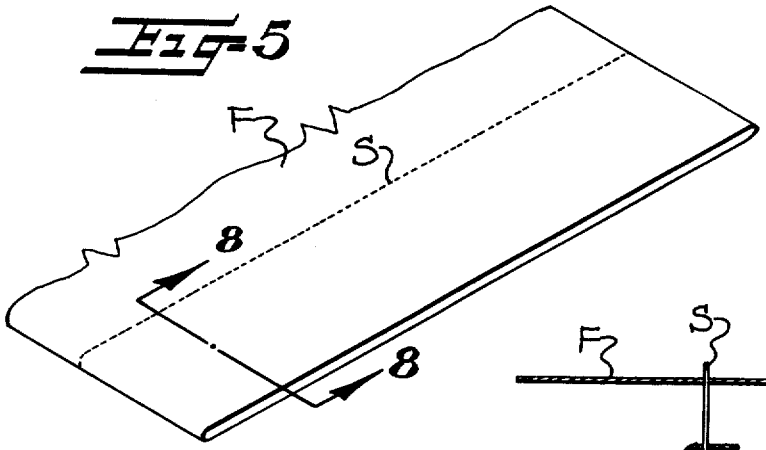
FIG. 7 is a fragmentary perspective view of a conventional folded hem style pillowcase.
Figure 8:
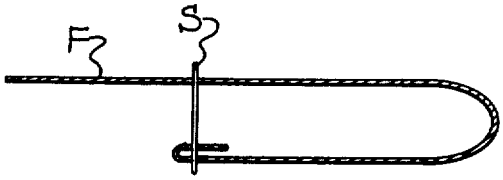
FIG. 8 is a cross sectional view of the folded hem style pillowcase taken substantially along the line 8—8 of FIG. 7.

FIGS. 7 and 8 illustrate the conventional folded hem style of the pillowcase. In this style, the end portion of the body-forming fabric F is folded inwardly upon itself and sewn to the overlying body-forming portion by stitching S.

Hemming Station

Referring now particularly to FIG. 1, the hemming station 20 is illustrated therein as it would appear when the apparatus is set up for manufacturing pillowcases of the attached hem style. It will be noted that with pillowcases of this style, the hem is not produced by folding but rather by a separate piece of attached fabric. Thus, as illustrated in FIG. 1 the fabric is directed by roller 11 to and through a series of rods collectively forming a tensioning station 21 serving primarily for controlling fabric tension and to assist in opening the fabric to its full width while removing wrinkles and folds from the fabric.

Upon leaving the tensioning station 21, the fabric is directed across rollers 12 and 13 which serve to reverse the direction of fabric travel and direct the fabric toward and through the hem sewing station 22 where the body-forming fabric F is assembled with the hem-forming fabric H and optionally with one or more additional decorative trim fabrics and sewn together in assembled relation by a sewing machine 25 to form the attached hem portion of the pillowcase.

Referring more particularly to this portion of the apparatus, as shown in detail in FIG. 1A, it will be seen that an indeterminate length relatively narrow width fabric web H for forming the hem portion of the pillowcase is directed from a suitable supply source such as fabric supply roll 14, and is directed across a folding device 15 which longitudinally folds the fabric H about the midpoint of its width so that the longitudinal edge portions of the fabric overlie one another. The folding device 15 also folds the hem-forming fabric H closely adjacent each raw edge thereof so that the raw longitudinal edges are located interiorly of the folded hem-forming fabric to present a finished appearance to the pillowcase. As the advancing hem-forming fabric H is folded in this manner, it is simultaneously guided into position with one longitudinal edge of the advancing body-forming fabric F of the pillowcase so that one longitudinal edge of the body-forming fabric F is positioned between the overlying longitudinal edge portions of the folded hem-forming fabric H.

Optionally, at the same time that the folded hem-forming fabric H is directed into position with the body-forming fabric F, decorative trim from one or more additional supply sources may be directed into position between the body-forming fabric F and one of the edge portions of the folded hem-forming fabric H. As shown in FIG. 1, two different decorative trims P and L are being directed from respective supply rolls 16 and 17 and into position for being sewn in place with the hem-forming fabric H by the sewing machine 25.

Preferably, for production and quality reasons, the sewing machine 25 is a commercially available chain stitch type sewing machine which does not require a bobbin thread as is employed in conventional lockstitch type machines, and is thus able to operate for longer periods of time and without the necessity of periodically refilling a bobbin. The type of stitch produced by the chain stitch machine is characterized by the presence of a series of loops or a "chain" on the surface of the reverse side of the fabric, with a series of stitches similar in appearance to a lockstitch visible on the front side of the fabric. In order to properly locate the chain stitches in the interior of the finished pillowcase, it is necessary when using the chain stitch type machines which are available commercially to reverse the direction of fabric travel prior to directing the fabric through the sewing machine. This is accomplished by rolls 12 and 13 in the arrangement of apparatus illustrated in FIG. 1.

The fabric F is advanced through the tensioning station 21 and hem sewing station 22 in a substantially continuous manner by means of driven rollers 12 and 18. As illustrated, a single motor 24 is operatively connected both to the sewing machine 25 and to the driven rollers 12 and 18 so that the movement of the fabric through the sewing machine is correlated with the operation of the sewing machine. Variable speed drives 26 are provided for fine adjustment of the rate of fabric travel relative to the rate of the sewing machine 25. The hemmed fabric, upon emerging from the sewing machine 25, passes through a heated iron 27 which presses a crease in the hem, and the hemmed fabric is then directed by additional guide rollers 28 and by driven roller 29 to a transitory accumulating station which precedes the cutting station.

FIG. 2 illustrates an alternate arrangement of the apparatus as employed for forming pillowcases of the conventional folded hem style. A somewhat similar arrangement is employed for forming pillowcases of the mock attached hem style. In the arrangement illustrated in FIG. 2, the body-forming fabric F is directed across a folding bar 23 located upstream of the tensioning station 21 while one longitudinal edge of the fabric is turned back upon itself as the fabric is advanced over the bar. Just prior to entering the sewing machine 25, the fabric passes through an additional folding guide 15*a* which forms a narrow fold to conceal the raw edge or selvage of the fabric in the interior of the hem as shown in FIG. 8 to present a more finished appearance to the hem.

Referring again to FIG. 1, the transitory accumulating station, indicated generally by the reference character 30, is provided between the hemming station 20 and the cutting station 40 and serves to permit the hemmed fabric to be delivered from hemming station 20 in a substantially continuous manner while being processed through the cutting station 40 in an intermittent movement. The transitory accumulating station 30, more particularly, includes a dancer arm 31 under which the fabric is threaded and which is mounted for pivotal movement as indicated by the arrow. The dancer arm 31 thus serves to take up any slack in the fabric and to thereby maintain the fabric in a slightly tensioned condition as it is continuously delivered from the hemming station by the continuously driven roller 29, while at the same time providing a sufficient reservoir of fabric for being quickly pulled through the cutting station and severed into separate pieces of predetermined length.

If desired, the pivotally mounted dancer arm 31 may be connected to a potentiometer (not shown) which in turn, regulates the speed of motor 24 in order to insure that the rate of continuous delivery of the fabric from the hemming station is correlated with the overall average rate at which the fabric is received and cut to length at the cutting station. Automatically regulating the speed of motor 24 in this manner facilitates operating the sewing machine substantially continuously without periodically stopping and starting the same in order to correlate the output of the fabric from the hemming station with the input at the cutting station.

Cutting Station

Figure 9:
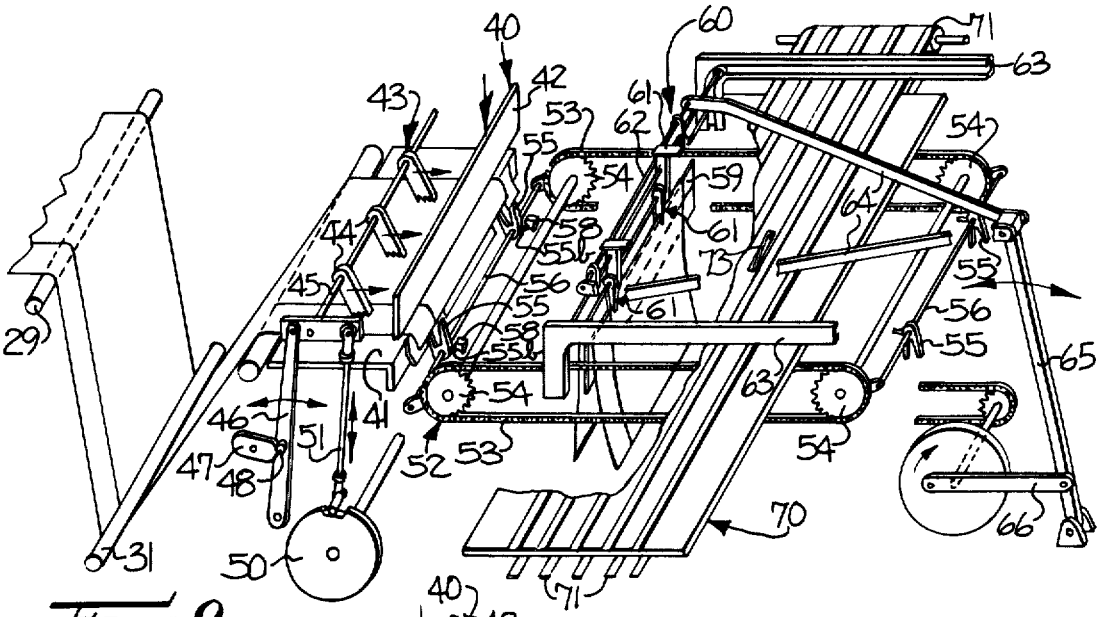
FIG. 9 is a schematic perspective view showing in somewhat greater detail than in FIG. 1 the cutting station and folding station of the apparatus.

The cutting station 40, as best illustrated in FIG. 9, includes a cutting table 41, the forwardmost edge of which defines an anvil which cooperates with a reciprocating cutter blade 42 for severing the fabric when the cutter blade moves downwardly into engagement with the anvil. The cutting station also includes a pusher assembly 43 which operates in the manner described hereinafter for pushing the leading cut edge of the fabric through the cutting station and beyond the cutter blade 42 and to a position where a gripper assembly can grasp the leading cut edge of the fabric and pull the fabric through the cutting station for predetermined distance prior to the next downward movement of the cutter blade.

The pusher assembly 43 includes a plurality of pusher arms 44 mounted for movement on a shaft 45 which, in turn, is mounted for reciprocating movement back and forth across the cutting table. Reciprocating movement of the shaft 45 is brought about by a driven arm 46, the upper end of which is connected to the shaft 45, and the lower end thereof being pivotally mounted to a stationary support (not shown). Drive arm 46 is rocked back and forth in a reciprocating manner as a result of engagement by a rotating cam 47 with a cam follower 48 carried by the drive arm 46. The pusher arms 44 are normally positioned slightly above the surface of the table 41 and thus out of engagement with the fabric located on the table. The pusher arms, however, are periodically lowered during the forward stroke of the reciprocating shaft 45 to bring the pusher arms 44 into engagement with the fabric lying on the table 41 and thereby push the fabric across the table so that the leading cut edge of the fabric is located beyond the forwardmost edge of the cutting table. The raising and lowering of pusher arms 44 is controlled by a rotating cam 50 (FIG. 9) and its associated follower arm 51 which is connected to the mounting block for shaft 45. So long as the follower arm 51 remains on the high portion of cam 50, the pusher arms 44 are maintained in a raised position out of engagement with cutting table 41, but when the reduced height portion of cam 50 passes under the follower arm 51, the pusher arms 44 are lowered into engagement with the cutting table 41 and the fabric located thereon. The movement of cams 47 and 50 are correlated so that the lowering of the pusher arms 44 occurs during the forward reciprocating stroke of shaft 45, resulting in the fabric being pushed forwardly across the cutting table to position the cut leading edge of the fabric a short distance beyond the plane of the cutting blade.

Located on the downstream side of the cutting table is a gripper assembly, generally indicated by the reference character 52, which is designed to grasp the leading cut edge of the fabric at the downstream side of the cutting table 41 and to pull a predetermined length of fabric through the cutting station preparatory to the next cycle of the cutter blade 42.

As best seen in FIG. 9, the gripper assembly 52 includes a pair of chains 53 mounted for movement on respective pairs of sprockets 54 and extending in respective endless parallel elongate paths from a point located closely adjacent the downstream end of the cutting table 41 to a point downstream therefrom and on the far side of the side seaming station 70. The pair of chains 53 serves to transport a plurality of sets of pulling grippers 55 which are adjustably mounted on respective supporting rods 56 extending between the respective chains.

The pulling grippers 55 each include a pair of cooperating pincher members, and an actuator leg 55*b* extending outwardly from one side of one of the pincher members. During the movement of the pulling grippers 55 in their endless path of travel, the actuator leg 55*b* is brought into engagement with respective stationary opening cams 57 and closing cams 58 which effect opening and closing of the pincher members 55*a*.

As illustrated, the chains 53 are so positioned as to bring a pair of pulling grippers 55 upwardly into position adjacent the downstream end of the cutting table so as to cause the leading cut end of the fabric to be received between the open outstretched pincher members. As the pulling grippers 55 continue their upward movement, the outwardly extending actuator leg 55*b* moves into engagement with stationary closing cam 58 which causes the pincher members of the pulling grippers to be snapped to a closed position.

Figure 10:
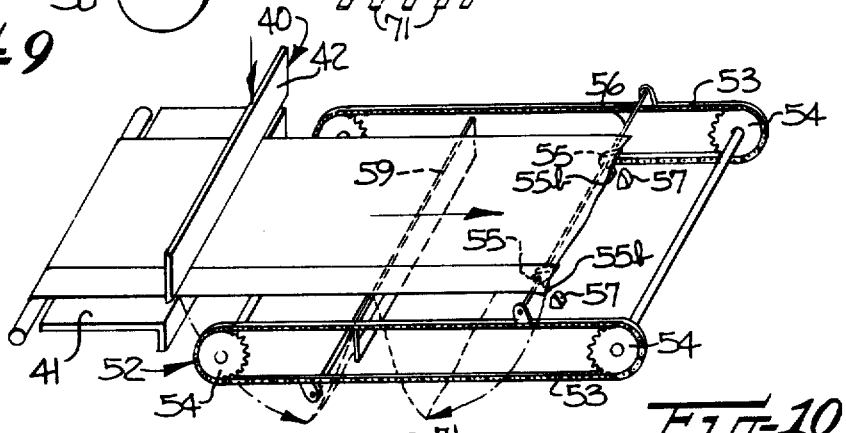
FIG. 10 is a view similar to FIG. 9 but showing the cutting station and folding station at a different stage in the cycle of operation.

As shown in FIG. 10, the pulling grippers 55, upon grasping the leading cut edge of the fabric, pull the fabric downstream for predetermined distance and across a folding bar 59 located approximately midway between the plane of the cutter blade 42 and the point where the pulling grippers release the leading cut edge of the fabric. As the pulling grippers continue their movement, the actuator legs 55*b* are brought into engagement with stationary opening cams 57 which cause the pincher members to be moved from the closed position to the open position thus releasing the leading cut edge of the fabric.

In the illustrated embodiment the chains 53 carry two sets of pulling grippers 55 so positioned that when one set of pulling grippers reaches the downstream extent of the chains and is ready to release the leading cut edge of the fabric, the other set of pulling grippers is ready at the upstream extent of the chains to pick up the cut edge of the fabric following the next cutting operation. This continuous motion provides for a highly productive cutting operation, avoiding wasted motion of a return stroke as would be inherent in a reciprocating type gripper motion.

Folding Station

The folding station 60 operates in timed relation with the cutting station 40 to grasp the cut piece of fabric at the folding bar 59 and to remove the piece from the folding bar to form a transversely extending fold line in the piece. More particularly, it will be seen that the folding station 60 includes a plurality of folding grippers 61 which are carried by a supporting rod assembly 62 which in turn is mounted for reciprocating movement along a predetermined path defined by trackways 63 in timed relation with the cutting of the fabric at the cutting station.

Figure 11:
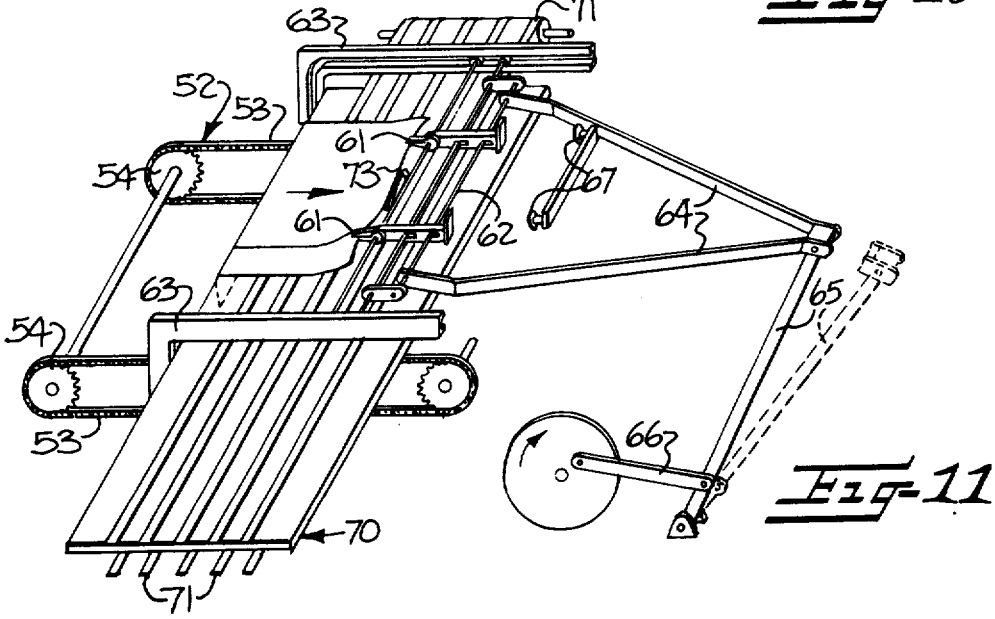
FIG. 11 is another view of the folding station showing still another stage in the cycle of operation thereof.

The coordinated operation of the cutting station 40 and the folding station 60 may be best understood by following the sequence of operations involved in the cutting and folding of a single pillowcase: Shortly after the cutter blade 42 moves upwardly after cutting the previous length of fabric, the pusher arms 44 advance the fabric downstream a short distance beyond the plane of movement of cutter blade and into position for being picked up by the pulling grippers 55. Simultaneously, the pulling grippers 55 move upwardly to receive and grasp the fabric. As the pulling grippers 55 are pulling the fabric through the cutting station and across the folding bar 59, the folding grippers 61 are being moved toward the folding bar 59. About the same time that the folding grippers 61 engage the fabric at the folding bar 59, or preferably a split second after the fabric is engaged and snubbed by the folding grippers 61 at the folding bar 59, the cutter blade 42 is actuated to sever the fabric into an individual piece. At about the same time that the cutter blade 42 is actuated, the pulling grippers 55 engage the stationary opening cam 57 and release the leading cut edge of the fabric. Both cut edges of the fabric having been released, the fabric assumes a draped condition across the folding bar 59 as indicated by the broken lines in FIG. 10. The folding grippers 61, which are now grasping the fabric at the folding bar 59 in the position indicated in FIG. 9, now move upwardly from the folding bar while carrying the fabric therewith and transferring the fabric onto the tape conveyor 71 of the side seaming station 70. As FIG. 11 shows, when the fabric is transferred onto the conveyor 71, the two cut edges of the fabric become positioned in overlying relation with one another along one side of the conveyor with the fold in the fabric being located adjacent the other side of the conveyor.

Referring now more particularly to the details of the gripper assembly, as best illustrated in FIGS. 12–15, the supporting rod assembly 62 comprises a pair of supporting rods 62*a*, 62*b* interconnected by connecting links 62*c* with the rods 62*a*, 62*b* being journaled at opposite ends in a groove formed in the trackway 63. An additional connecting link 62*d* connects the two supporting shafts to a V-shaped actuator yoke 64, (FIG. 9) which in turn is connected to a reciprocating arm 65, which is driven by a crank assembly 66 so that the supporting rod assembly 62 is moved in a reciprocating manner longitudinally along the trackway groove from the position shown in FIG. 9 to that shown in FIG. 11.

The folding grippers 61 which are mounted on the supporting rods 62*a*, 62*b* include an elongate mounting block 61*a* and a pair of gripper arms 61*b*. The gripper arms 61*b* are pivotally mounted on the forwardmost supporting rod 62*a* and are biased toward one another by means of a circular shaped leaf spring 61*c*. A rod-like projection 61*d* extends from the side of each gripper arm for a short distance, and cooperates with a configured camming surface formed in the side of mounting block 61*a* for effecting opening and closing of the gripper arms 61*b*. The mounting block 61*a* has a pair of elongate slot-like openings formed therein through which the supporting rods 62*a*, 62*b* extend and which allows the mounting block to move relative to the adjacent gripper arms 61*b* so that the rod-like projections 61*d* can move from the high point on the camming surface, which cause the gripper arms to be maintained in an open position, to a low point on the camming surface which allow the gripper arms to move to a closed position.

Figure 12:
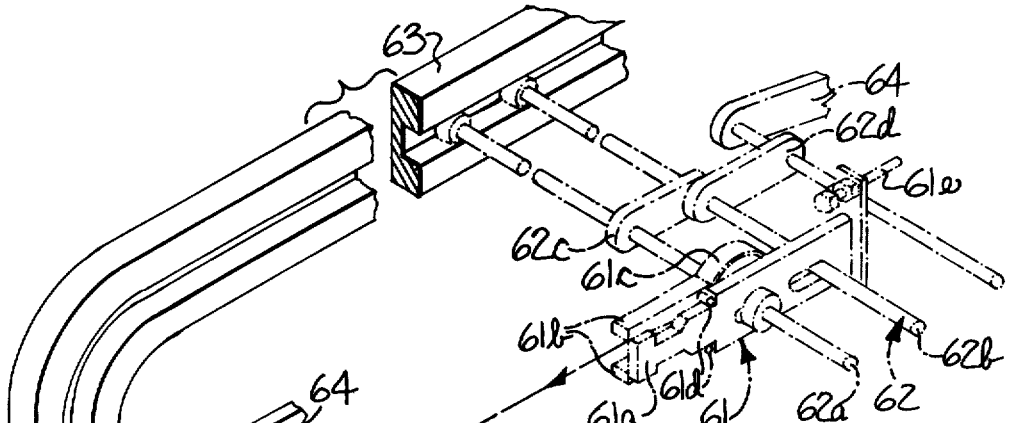
FIG. 12 is a detailed perspective view of a portion of the folding station and particularly illustrating the mechanism for grasping the folded portion of the pillowcase fabric.
Figure 14:
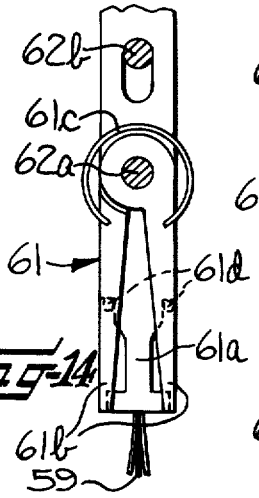
FIGS. 14 and 15 are detailed end views of the mechanism for grasping the folded portion of the pillowcase fabric.
Figure 15:
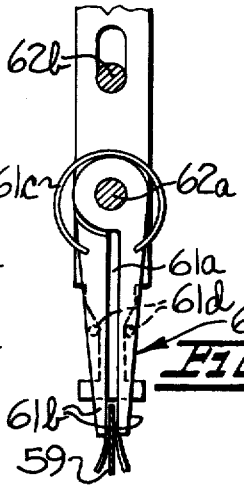
Figure 17:
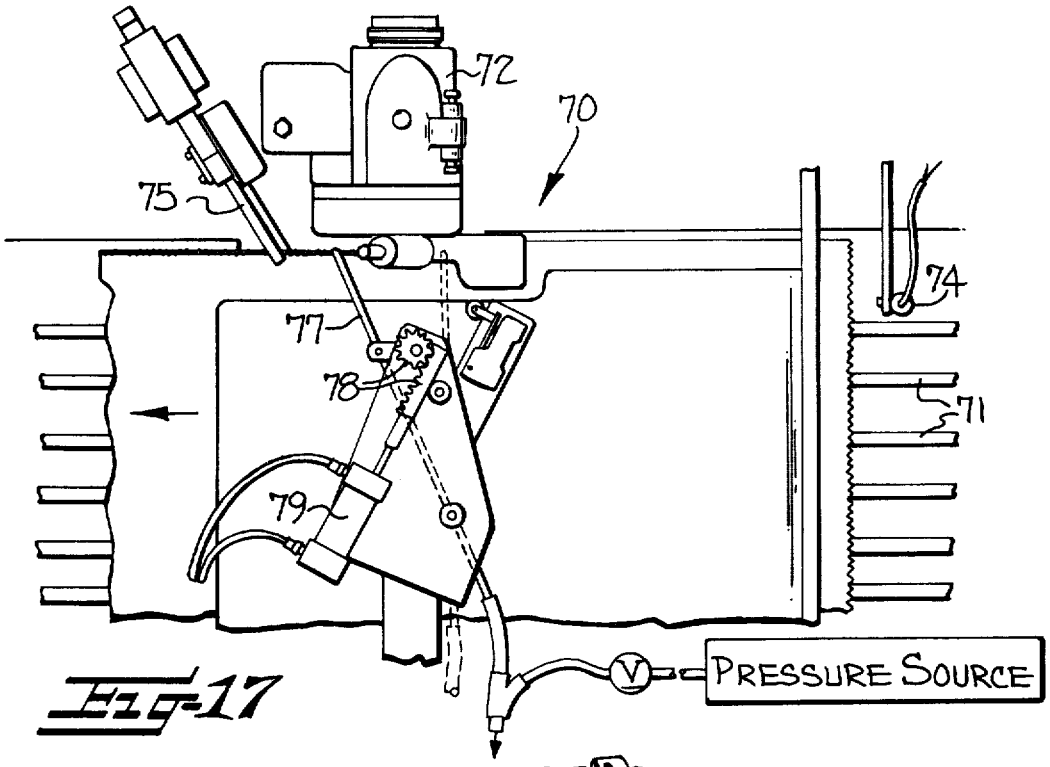
FIG. 17 is a plan view showing the side seaming station.

During operation of the folding mechanism, the folding grippers 61 move toward the folding bar 59 as indicated by the arrows in FIG. 12 with the gripper arms 61*b* in the open position. As the folding grippers approach the folding bar, the endmost surface of the mounting block 61*a* engages the folding bar 59 and is caused to stop. At this point the gripper arms 61*b* are in the open position as indicated in FIG. 14. As the supporting rods 62*a*, 62*b* continue their downward movement in the trackways 63 the gripper arms 61*b* continue to move downwardly relative to the now immobilized mounting block 61*a* and to the position shown in FIG. 15. During this relative movement between the mounting block 61*a* and gripper arms 61*b*, the projections 61*d* on the gripper arms are moved to the low point on the camming surface which allows the gripper arms to move to a closed position in engagement with the folding bar and the fabric draped thereacross. The supporting rods 62*a*, 62*b* now reverse direction and begin to move upwardly relative to the folding bar while causing the folded piece of fabric to be pulled from the folding bar and while carrying the folded piece downstream to the conveyor 71. As the folding grippers 61 reach the limit of their travel at the opposite end of the trackways 63, adjustable abutment screws 61*e* carried by the mounting block come into engagement with a stationary abutment stop 67 (FIG. 11) which cause the mounting block 61*a* to be shifted relative to the gripper arms 61*b* to thereby open the gripper arms and release the fabric onto the conveyor 71 therebelow.

Side Seaming Station

Figure 16:
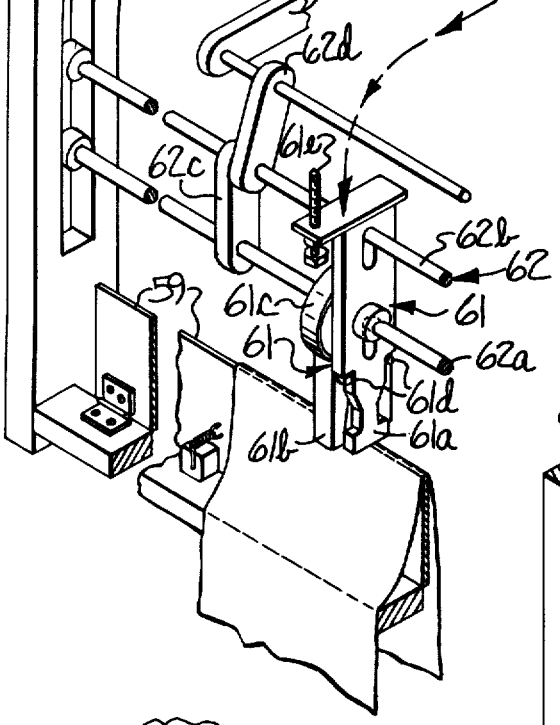
FIG. 16 is a detailed elevational view of the sensing switch shown in FIG. 11.
Figure 16:
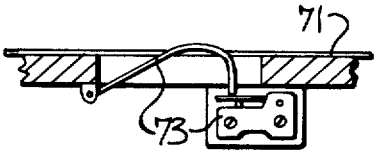
Figure 13:
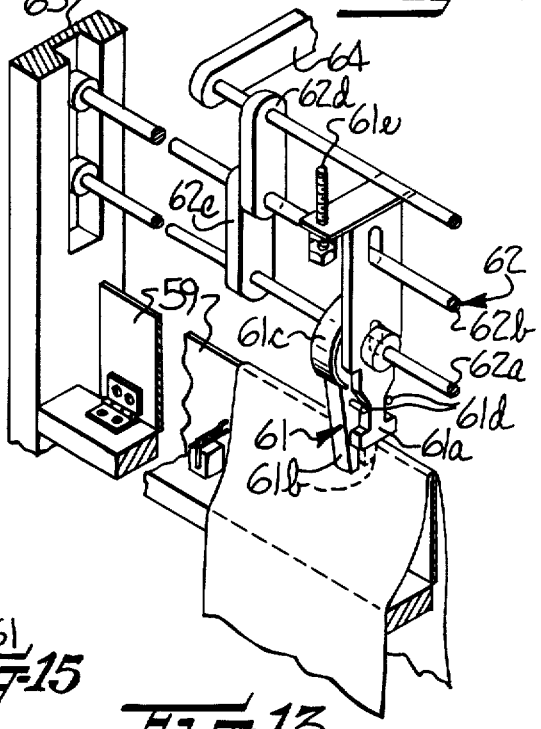
FIG. 13 is another view of the folding station further illustrating the mechanism for grasping the folded portion of the pillowcase fabric.

After a folded piece of fabric has been deposited on the conveyor 71, the conveyor is actuated to advance the piece toward and through a sewing machine 72 positioned for forming a seam along the overlying cut edges of the folded piece of fabric. A microswitch 73 (FIG. 16) located at the upstream end of conveyor 71 where the folded pieces of fabric are deposited, in combination with other suitable control circuitry, not specifically shown, senses when a folded piece of fabric has been received on the conveyor and activates conveyor 71, while insuring that the conveyor is not advanced until a piece is in place on the conveyor. As the folded piece advances along conveyor 71 toward the sewing machine 72, a photoelectric eye 74 senses the arrival of the piece and actuates the sewing machine 72.

While various types of commercially available sewing machines may be suitably employed for the side seaming operation, the preferred type of machine as illustrated, is a commercially available over-edge sewing machine. As is well known, this type of machine is advantageous over a lock-stitch type of machine in high production applications in that it does not use a bobbin and thus can be operated substantially continuously without the need for periodically stopping to refill the bobbin. This type of machine forms a continuous chain stitch in the pieces of fabric which are advanced therethrough while also trimming the marginal edges of the thus stitched pieces so that the line of stitching is located at the edge of the sewn fabric.

The chain stitch which is produced by this kind of machine will be formed regardless of whether there is fabric beneath the sewing needle. Thus, when successive individual pieces of the fabric are passed through the machine, a series of chain stitches or thread chain will be formed extending between and interconnecting the successive pieces. In accordance with this invention, a cutter 75 is mounted adjacent to sewing machine 72 and is operated periodically in timed relation with the advancement of the successive pieces of fabric along the conveyor 71 to sever the thread chain which extends between and interconnects the successive pieces.

It will be noted that the pillowcases are advanced along the conveyor with the hem portion which forms the mouth of the pillowcase oriented forwardmost. Thus, the hemmed portions of the pillowcase are presented first to the sewing machine 72 and sewn together, which facilitates maintaining the hemmed portions in proper longitudinal alignment. To avoid having the thread chain protruding from the mouth of the pillowcase, the side seaming station 70 includes a device for capturing the dangling thread chain upon severing thereof from the preceding piece and positioning the captured end portion of the thread chain along the cut edges of the next piece which is being advanced to the sewing machine so that the thread chain is sewn into the seam being formed in this piece. This not only prevents the chain from protruding from the mouth of the pillowcase, but also serves to prevent unraveling of the end portion of the thread chain.

Figure 18:
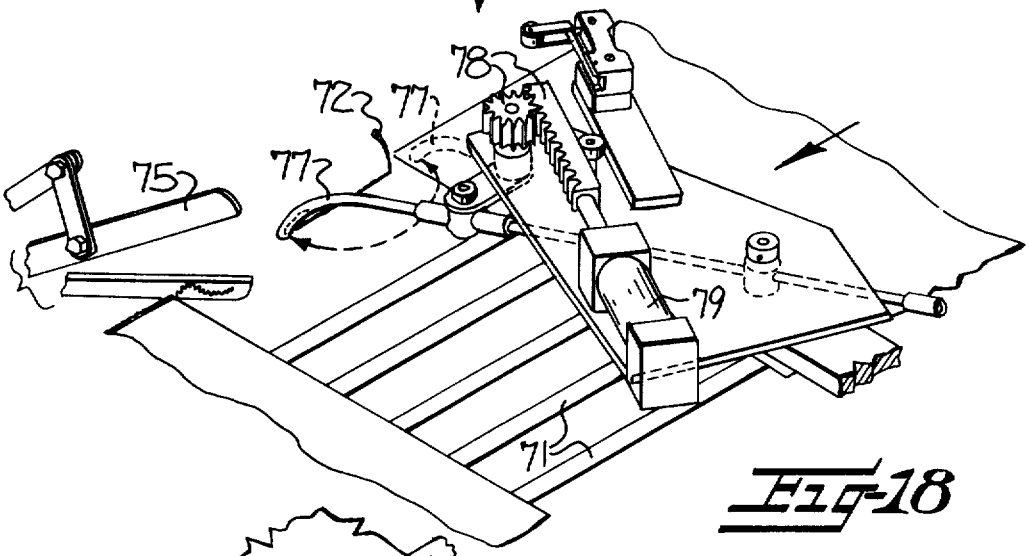
FIG. 18 is a fragmentary prspective view of the side seaming station showing the mechanism for severing and grasping the thread chains which extend between successive pillowcases.
Figure 19:
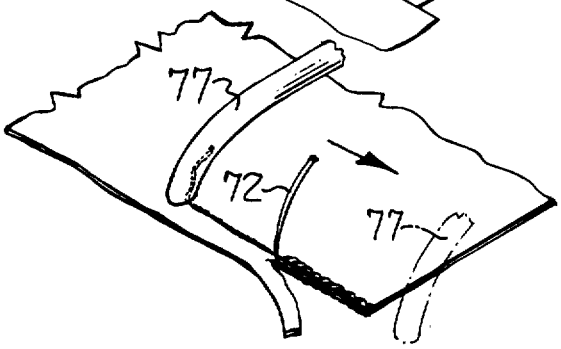
FIG. 19 is a more detailed perspective view of the apparatus of FIG. 18 showing how the thread chain is sewn into the side seam of the pillowcase.

The apparatus utilized for capturing the thread chain includes a suction tube 77 which is positioned to pick up the dangling end of the thread chain upon severing thereof from the preceding piece. The suction tube 77 is mounted for pivotal movement to quickly pull the thread chain in the upstream direction, (i.e. opposite the direction of fabric advancement through the sewing machine, as indicated by the arrows in FIG. 18 and as also shown in FIG. 19) to thereby position the thread chain alongside the edge of the fabric being advanced to the sewing machine needle. Movement of the suction tube 77 is effected by a rack and pinion gear assembly 78, which in turn, is connected to an air cylinder 79 which imparts movement to the rack and pinion assembly.

End Seaming Station

Figures 20, 21, 22:
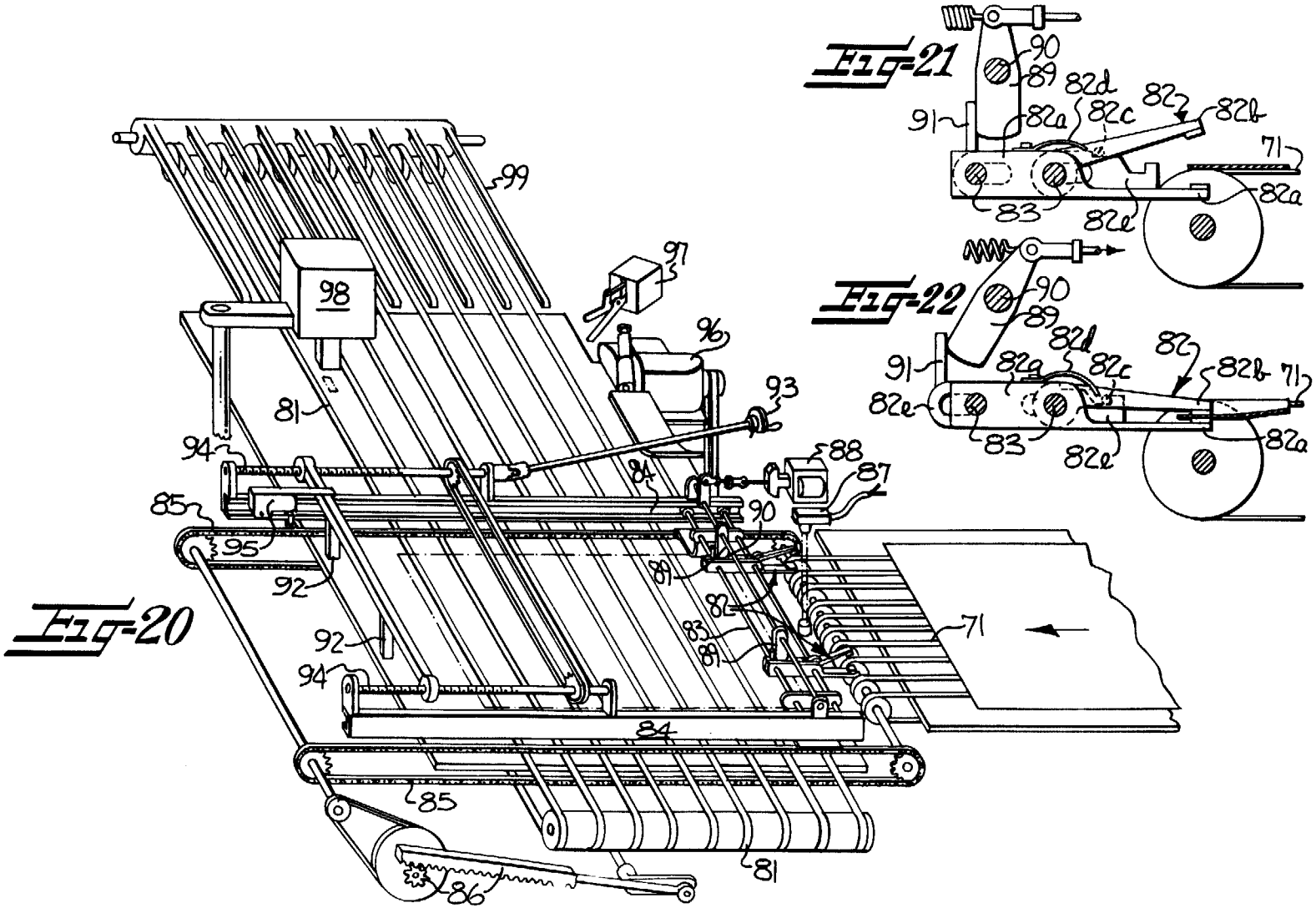
FIG. 20 is a perspective view showing the end seaming station and stacking station of the apparatus.
FIGS. 21 and 22 are detailed elevational views showing the mechanism for grasping the pillowcases as they are delivered from the side seaming station and for transferring them onto the conveyor to the end seaming station.

Referring now to FIG. 20, it will be seen that as the pillowcases reach the downstream end of tape conveyor 71, they are transferred onto another tape conveyor 81 which serves the end seaming station 80. More particularly, it will be seen that a pair of transfer grippers 82 are positioned to receive the leading end of the pillowcase as it reaches the downstream end of conveyor 71 and to pull the pillowcase from the conveyor 71 and onto the upstream end of conveyor 81. The transfer grippers 82 are mounted on supporting rods 83 which, in turn, are journaled for longitudinal sliding movement in trackways 84 which overlie and extend perpendicular to the conveyor 81. A pair of chains 85 are connected to the supporting rods 83, and to a rack and pinion drive assembly 86, and serve to move the supporting rods 83 along the trackways 84 so as to, in turn, reciprocatingly move the transfer grippers 82 toward and away from the downstream end of conveyor 71 in timed relation with the arrival of pillowcases at the downstream end of the conveyor so that the pillowcases are pulled from conveyor 71 and deposited onto the conveyor 81.

A photoelectric eye 87 senses the arrival of the pillowcase at the downstream end of conveyor 71 and actuates a solenoid 88 which, in turn, causes a pair of cams 89 to be pivotally moved on their supporting shaft 90. As shown in detail in FIGS. 21 and 22, when the cams 89 are pivotally moved from the position shown in FIG. 21 to that shown in FIG. 22, an upstanding abutment member 91 on the transfer gripper 82 is longitudinally shifted and the gripper is moved from an open to a closed position.

The transfer gripper 82, more particularly, includes a body member 82*a* having a laterally extending portion defining the lower gripper arm, an upper gripper arm 82*b* pivotally connected to the body member 82*a* and cooperating with the lower gripper arm and having a rod-like cam follower 82*c* extending therefrom, a leaf spring 82*d* which biases the gripper arms toward a closed position, and a cam block 82*e* which is slidably movable relative to the body member 82*a* and which has a configured cam surface thereon which cooperates with the cam follower 82*c* for effecting opening and closing of the gripper arms. The abutment member 91 extends upwardly from the cam block 82*e* and as seen in FIGS. 21 and 22, by sliding the cam block 82*e* to the left, the configured cam surface thereof allows the cam follower 82c to permit the spring loaded gripper arm to move to the closed position.

As seen in FIG. 20, a pair of stationary abutments 92 are provided at the far end of the trackways 84 for engaging the upstanding abutment member 91 on cam blocks 82e and effecting opening of the transfer grippers. The position of the abutments 92 can be adjusted as desired, by turning handcrank 93 which, in turn, rotates the threaded rods 94 to which the abutments 92 are mounted. In this manner the operator can adjust exact location where the pillowcases are deposited on the conveyor 81 in order to have proper alignment of the end portion of the pillowcase relative to the end seaming sewing machine. Arrival of the transfer grippers at the far end of the trackway is sensed by a switch 95, which causes the grippers to reverse direction and return to the opposite end of trackways 84 adjacent the downstream end of conveyor 71 and ready to receive another pillowcase.

After a pillowcase has been deposited on the tape conveyor 81, the conveyor is actuated to advance the pillowcase through a sewing machine 96 to form a seam along the end of the pillowcase located opposite the hem and thereby closing the end of the piece to form a completed pillowcase therefrom. The sewing machine 96 may be of any suitable type, but preferably and as illustrated, an over-edge sewing machine of a type similar to that used at the side seaming station is employed. A short distance downstream from the sewing machine 96 a cutter 97 is provided to sever the thread chains which extend between and interconnect successive pillowcases.

At this location there may also be provided, if desired, a labeling machine 98 for securing a label to the inside of the hem portion of the completed pillowcase.

As the pillowcase reaches the downstream end of the tape conveyor 81, a flipper assembly 99 is actuated to remove the pillowcase from the conveyor and deposit the same in a stack at the downstream end of the conveyor. The pillowcases are subsequently everted to render them in a "right side out" orientation, and may then be folded and packaged.

In the drawings and specification, there have been set forth preferred embodiments of the invention, and although specific terms are employed, they are used in a generic and descriptive sense only and not for purposes of limitation.

That which is claimed is:

1. Apparatus for continusouly manufacturing pillowcases having an attached hem along the mouth of the pillowcase, said apparatus comprising means for receiving from a supply source an indeterminate length relatively narrow width fabric web for forming a hem and longitudinally folding the web about the midpoint of its width so that the longitudinal edge portions thereof overlie one another, means for simultaneously receiving from another supply source an indeterminate length relatively wider fabric web for forming the body portion of a pillowcase and positioning one longitudinal edge thereof between the overlying longitudinal edge portions of the folded hem forming web, a hem sewing station positioned for receiving the thus associated hem-forming and body-forming webs and including means for sewing the overlying edge portions of the folded hem-forming web to the portion of the body-forming web positioned therebetween to thereby form an attached hem along one longitudinal edge of the continuous length body-forming web, a cutting station positioned for receiving the hemmed body-forming web from the hem sewing station and including cutter means for cutting the web into successive individual pieces of predetermined length, a folding station positioned for receiving the successive cut pieces from the cutting station and including means for successively folding the cut pieces along a transversely extending fold line located medially of the cut edges to position the cut edges of each successive piece in closely adjacent relation to one another and with the hemmed longitudinal edges in substantial alignment with one another, a side seaming station positioned for receiving the successive folded pieces from the folding station and including means for sewing along the closely adjacent cut edges of the successive pieces to form a seam therealong, and an end seaming station positioned for receiving the successive pieces from the side seaming station and including means for sewing each successive piece along the edge located opposite the hem to form a seam therealong and thereby close the end of the piece to form a pillowcase therefrom.

2. Apparatus according to claim 1 wherein said side seaming station includes an elongate conveyor operably associated with said folding station for receiving the successive folded pieces therefrom with the respective folds being located adjacent one side of the conveyor and with the closely adjacent cut edges of the pieces being located adjacent the opposite side of the conveyor, and said means for sewing along the closely adjacent cut edges of the successive pieces comprises a sewing machine positioned adjacent said opposite edge of the conveyor and operable for forming a seam along the cut edges of the pieces as the pieces are advanced along the conveyor with sewing threads extending between and interconnecting the successive pieces, and means associated with said side seaming station for successively severing the sewing threads which interconnect successive pieces.

3. Apparatus according to claim 2 wherein said means for sewing along the cut edges of the successive pieces comprises an overedge sewing machine operable for forming an overedge seam along the cut edges of the successive pieces and also operable for forming thread chains extending between and interconnecting the successive pieces.

4. Apparatus according to claim 2 wherein said end seaming station includes an elongate conveyor oriented generally perpendicular to the elongate conveyor of said side seaming station, means for successively transferring the pieces from the side seaming conveyor to the end seaming conveyor while positioning the pieces in successive relation on the end seaming conveyor with the respective hem portions being located adjacent one side of the conveyor and with the opposite edge portions located adjacent the opposite side of the conveyor, and wherein said means for sewing each successive piece along the edge located opposite the hem comprises a sewing machine positioned adjacent said opposite side of the second conveyor and operable for forming a seam along the edge portion of the pieces to form successive pillowcases therefrom.

5. Apparatus according to claim 4 wherein said means for successively transferring the pieces from the side seaming conveyor to the end seaming conveyor comprises gripper means mounted for reciprocating movement adjacent the downstream end of the side seaming conveyor and operating in timed relation with the advancement of the successive pieces along the side seaming conveyor from the side seaming sewing machine for graspingly escaping forwardmost portions of the successive pieces from the side seaming conveyor and pulling the pieces onto the end seaming conveyor.

6. Apparatus according to claim 1 wherein said cutting station comprises means for successively grasping the leading cut edge of the hemmed body-forming web at said cutter means and pulling the leading cut edge of the web downstream for a predetermined distance, and said folding station comprises a folding bar located downstream from said cutter means a predetermined distance so that the web is pulled across and beyond the folding bar, and means operating in timed relation with the cutting of the web by said cutter means for grasping the piece at the folding bar and removing the piece therefrom to form a fold.

7. Apparatus according to claim 6 wherein said means for grasping and pulling the leading cut edge of the hemmed body-forming web comprises an elongate endless conveyor and a plurality of sets of grippers carried by said conveyor and adapted for movement therewith along a repeating endless path, one end portion of said elongate conveyor being located adjacent said cutter means and positioned to bring the respective sets of grippers into grasping engagement with the leading cut edge of the body-forming web at the cutter means, and said conveyor extending downstream from said cutter means and beyond said folding bar for a predetermined distance to pull the leading cut edge of the web therewith, and said sets of grippers being located in spaced relation from one to another on said conveyor so that as one set of grippers is completing the pulling of the web across and beyond the folding bar, another set of grippers is being brought into position adjacent the cutter means for grasping and pulling the web.

8. Apparatus according to claim 7 wherein said one end portion of said elongate conveyor is so located relative to said cutter means as to bring the respective sets of grippers adjacent the downstream side of said cutter means, and wherein said cutting station includes pusher means operating in timed relation with the cutting of the web for pushing the leading cut edge of the hemmed body-forming web through the cutter means to facilitate grasping of the leading cut edge by said sets of grippers on the downstream side of the cutter means.

9. Apparatus for continuously manufacturing pillowcases comprising a cutting station adapted for receiving an indeterminate length fabric web having a hem formed along one longitudinal edge thereof and including means for cutting the indeterminate length web into successive individual pieces of predetermined length, a folding station positioned for receiving the successive cut pieces from the cutting station and including means for successively folding the cut pieces along a transversely extending fold line located medially of the cut edges to position the cut edges of each successive piece in closely adjacent relation to one another and with the hemmed longitudinal edges in substantial alignment with one another, a side seaming station positioned for receiving the successive folded pieces from the folding station and including means for sewing along the closely adjacent cut edges of the successive pieces to form a seam therealong and also forming thread chains extending between and interconnecting the successive pieces, and said side seaming station also including means for successively severing the thread chains which interconnect the successive pieces, and an end seaming station positioned for receiving the successive pieces from the side seaming station and including means for sewing each successive piece along the edge located opposite the hem to form a seam therealong and thereby close the ends of the pieces to form successive pillowcases therefrom.

10. Apparatus according to claim 9 wherein said side seaming station includes means operating in timed relation with said thread chain severing means for capturing the end portion of the severed thread chain extending at the leading end of each successive piece upon the severing of the thread chain from the preceding piece, and for positioning the captured end portion of the thread chain along the cut edges of the piece so that the thread chain is sewn into the seam being formed along the edge of the piece to thereby prevent unraveling of the end portion of the thread chain.

11. Apparatus for continuously manufacturing pillowcases comprising a cutting station adapted for receiving an indeterminate length fabric web having a hem formed along one longitudinal edge thereof and including means for cutting the indeterminate length web into successive individual pieces of predetermined length, a folding station positioned for receiving the successive cut pieces from the cutting station and including a folding bar located downstream from said cutting station a predetermined distance, an elongate endless conveyor, and a plurality of sets of grippers carried by said conveyor and adapted for movement therewith along a repeating endless path, one end portion of said elongate conveyor being located adjacent the downstream side of said cutting station and positioned to bring the respective sets of grippers into grasping engagement with the leading cut edge of the continuous web at the cutting station, and said conveyor extending downstream from said cutting station and beyond said folding bar for a predetermined distance whereby said grippers, upon engaging the leading cut edge of the web, serve to pull the leading cut edge of the web therewith across and beyond the folding bar, and said sets of grippers being located in spaced relation from one another on said conveyor so that as one set of grippers is completing the pulling of the web across and beyond the folding bar, another set of grippers is being brought into position adjacent the cutting station for grasping and pulling the web, and said folding station also including means operating in timed relation with said grippers and with the cutting of the web into an individual piece for grasping the piece at the folding bar and removing the piece therefrom to form a transversely extending fold line located medially of the cut edges and to position the cut edges of each successive piece in closely adjacent relation to one another and with the hemmed longitudinal edges in substantial alignment with one another, a side seaming station positioned for receiving the successive folded pieces from the folding station and including means for sewing along the closely adjacent cut edges of the successive pieces to form a seam therealong, and an end seaming station positioned for receiving the successive pieces from the side seaming station and including means for sewing each successive piece along the edge located opposite the hem to form a seam therealong and thereby close the end of the piece to form a pillowcase therefrom.

12. Apparatus according to claim 11 wherein said cutting station includes pusher means operating in timed relation with the cutting of the web for pushing the leading cut edge of the web through the cutting station to facilitate grasping of the leading cut edge by said sets of grippers on the downstream side of the cutting station.

* * * * *